US009842539B2

(12) United States Patent
Hung et al.

(10) Patent No.: US 9,842,539 B2
(45) Date of Patent: Dec. 12, 2017

(54) PIXEL CONTROL CIRCUIT

(71) Applicant: AU Optronics Corp., Hsin-Chu (TW)

(72) Inventors: Sen-Chuan Hung, Hsin-Chu (TW); Chia-Yuan Yeh, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 161 days.

(21) Appl. No.: 14/850,946

(22) Filed: Sep. 10, 2015

(65) Prior Publication Data

US 2016/0307504 A1 Oct. 20, 2016

(30) Foreign Application Priority Data

Apr. 16, 2015 (TW) ..... 104112269 A

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01)

(58) Field of Classification Search
CPC ... G09G 2300/0819; G09G 2300/0842; G09G 2300/0861; G09G 3/3233
See application file for complete search history.

(56) References Cited

U.S. PATENT DOCUMENTS 9,214,506 B2 12/2015 Xie
2007/0273618 A1* 11/2007 Hsieh ..... G09G 3/3233 345/76
2009/0146987 A1* 6/2009 Kim ..... G09G 3/3233 345/212
2009/0309516 A1* 12/2009 Kim ..... G09G 3/3233 315/307
2011/0115772 A1* 5/2011 Chung ..... G09G 3/3233 345/211

(Continued)

FOREIGN PATENT DOCUMENTS

CN 102982767 A 3/2013
CN 103150991 6/2013
CN 203812537 U 9/2014

OTHER PUBLICATIONS

State Intellectual Property Office of the P. R. C, "Office Action", dated Mar. 2, 2017, China.

*Primary Examiner* — Viet Pham
(74) *Attorney, Agent, or Firm* — Locke Lord LLP; Tim Tingkang Xia, Esq.

(57) ABSTRACT

A pixel control circuit includes an organic light emitting diode, a driving transistor, a driving circuit, a discharge circuit and a compensation circuit. The driving transistor is used to turn on or turn off the organic light emitting diode. The discharge circuit is used to control the electrical connection between the organic light emitting diode and an initial voltage to timely provide a discharge path for the organic light emitting diode. The compensation circuit is used to compensate a conducting current for the organic light emitting diode when the organic light emitting diode emits light so that the conducting current is independent of a threshold voltage of the driving transistor. The driving circuit is used to control the electrical connection between a predetermined voltage and the driving transistor to make the organic light emitting diode emit light.

15 Claims, 9 Drawing Sheets

(56) References Cited

U.S. PATENT DOCUMENTS

| | | | | |
|---|---|---|---|---|
| 2011/0157135 | A1 | 6/2011 | Lee | |
| 2011/0164018 | A1* | 7/2011 | Kang | G09G 3/3233 345/211 |
| 2011/0193850 | A1* | 8/2011 | Chung | G09G 3/3233 345/212 |
| 2011/0285691 | A1* | 11/2011 | Takasugi | G09G 3/3233 345/212 |
| 2012/0199854 | A1* | 8/2012 | Noguchi | H01L 27/3276 257/88 |
| 2013/0321372 | A1* | 12/2013 | Hung | G11C 19/00 345/211 |
| 2014/0084805 | A1 | 3/2014 | Kim | |
| 2014/0333686 | A1* | 11/2014 | Kim | G09G 3/3233 345/694 |
| 2015/0221252 | A1* | 8/2015 | Qing | G09G 3/3233 345/76 |
| 2015/0348462 | A1* | 12/2015 | Ma | G09G 3/3225 345/78 |
| 2016/0071464 | A1* | 3/2016 | Park | G09G 3/3291 345/212 |
| 2016/0125808 | A1* | 5/2016 | Hsu | G09G 3/3233 345/212 |

* cited by examiner

PIXEL CONTROL CIRCUIT

BACKGROUND OF THE INVENTION

1. Field of the Invention

This invention relates to a pixel control circuit, and especially relates to a pixel control circuit that is able to avoid a brightness of the pixel from being affected by characteristics of transistors.

2. Description of the Prior Art

FIG. 1 shows a pixel control circuit 100 according to prior art. The pixel control circuit 100 includes a switch T1A, a driving transistor T1B, a capacitor C1, and an organic light emitting diode 110. The switch T1A has a first terminal for receiving a data signal $S_{data}$, a second terminal, and a control terminal for receiving a scan signal $S_{scan}$. The driving transistor T1B has a first terminal for receiving a system voltage OVDD, a second terminal coupled to a first terminal of the organic light emitting diode 110, and a control terminal coupled to the second terminal of the switch T1A. The capacitor C1 has a first terminal for receiving the system voltage OVDD, and a second terminal coupled to the control terminal of the driving transistor T1B.

When the switch T1A is turned on by the scan signal $S_{scan}$, the driving transistor T1B can conduct a current $I_{OLED}$ according a voltage of the data signal $S_{data}$ to turn on the organic light emitting diode 110. The current $I_{OLED}$ can be represented as $I_{OLED}=K(V_{SG}-|V_{TH}|)^2$ according to characteristics of the transistors, where K represents a manufacturing parameter of the driving transistor T1B, $V_{SG}$ represents a source-to-gate voltage of the driving transistor T1B, and $V_{TH}$ represents the threshold voltage of the driving transistor T1B. In FIG. 1, the driving transistor T1B is a P-type metal-oxide-semiconductor transistor, and the source-to-gate voltage $V_{SG}$ is the system voltage OVDD minus the voltage of the data signal $S_{data}$.

Consequently, although the pixel control circuit 100 may control the strength of the current $I_{OLED}$ flowing through the organic light emitting diode 110 according to the voltage of the data signal $S_{data}$, each of the pixels in a display may still have different brightness even if each of the pixels shows a brightness according to the same data signal $S_{data}$, due to different characteristics of transistors in each of the pixels, which may cause luminance nonuniformity. This is because the threshold voltage $V_{TH}$ of the driving transistor T1B may be affected by the manufacturing process or may be changed after being used for a long time. Thus, the image quality may also drop as the time goes by.

Furthermore, since the pixels are disposed in different positions of the display, the system voltage OVDD received by each of the pixels may also be different due to different levels of resistance of the OVDD transmission line, which makes it even more difficult to control the luminance uniformity.

In addition, since the pixel control circuit 100 does not provide the organic light emitting diode 110 with any discharge path, there may be some charges remaining in the organic light emitting diode 110 after a previous image is over. Therefore, if the following image is a black image, the display may have the issue of not being dark enough while displaying the black image.

SUMMARY OF THE INVENTION

One embodiment of the present disclosure discloses a pixel control circuit. The pixel control circuit comprises an organic light emitting diode, a first switch, a driving transistor, a driving circuit, a compensation circuit and a discharge circuit. The organic light emitting diode has a first terminal, and a second terminal configured to receive a first default voltage. The first switch has a first terminal configured to receive a data signal, a second terminal, and a control terminal configured to receive a first control signal. The driving transistor has a first terminal coupled to the second terminal of the first switch, a second terminal coupled to the first terminal of the organic light emitting diode, and a control terminal. The driving circuit is coupled to the first terminal of the driving transistor, and configured to receive a second default voltage and control an electrical connection between the second default voltage and the driving transistor according to an emission control signal. The compensation circuit is coupled to the driving circuit and the control terminal of the driving transistor, and configured to receive a reference voltage and control an electrical connection between the control terminal of the driving transistor and the second terminal of the driving transistor according to a second control signal. The discharge circuit is coupled to the first terminal of the organic light emitting diode and an initial voltage, and configured to control the electrical connection between the first terminal of the organic light emitting diode and the initial voltage according to a third control signal.

These and other objectives of the present disclosure will no doubt become obvious to those of ordinary skill in the art after reading the following detailed description of the preferred embodiment that is illustrated in the various figures and drawings.

DETAILED DESCRIPTION

Figure 2:
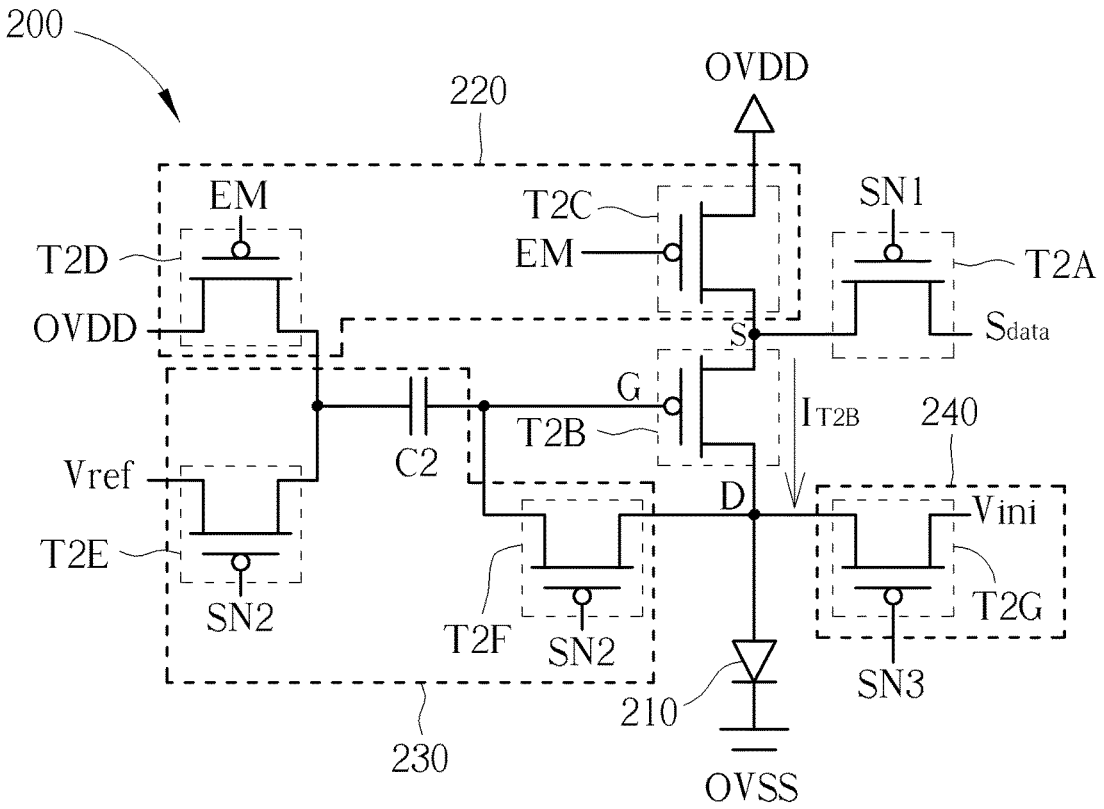
FIG. 2 shows a pixel control circuit according to one embodiment of the present disclosure.

FIG. 2 shows a pixel control circuit 200 according to one embodiment of the present disclosure. The pixel control circuit includes an organic light emitting diode 210, a switch T2A, a driving transistor T2B, a driving circuit 220, a compensation circuit 230, and a discharge circuit 240. The organic light emitting diode 210 has a first terminal, and a second terminal for receiving a default voltage OVSS.

The switch T2A has a first terminal for receiving a data signal $S_{data}$, a second terminal, and a control terminal for receiving a first control signal SN1. The driving transistor T2B has a first terminal S coupled to the second terminal of the switch T2A, a second terminal D coupled to the first terminal of the organic light emitting diode 210, and a control terminal G.

The driving circuit 220 is coupled to the first terminal S of the driving transistor T2B, and for receiving a default voltage OVDD and control an electrical connection between the default voltage OVDD and the driving transistor T2B according to an emission control signal EM. The compensation circuit 230 is coupled to the driving circuit 220 and the control terminal G of the driving transistor T2B, and for receiving a reference voltage Vref and control an electrical connection between the control terminal G of the driving transistor T2B and the second terminal D of the driving transistor T2B according to a second control signal SN2. The discharge circuit 240 is coupled to the first terminal of the organic light emitting diode 210 and an initial voltage Vini, and configured to control the electrical connection between the first terminal of the organic light emitting diode 210 and the initial voltage Vini according to a third control signal SN3.

In some embodiments of the present disclosure, the driving circuit 220 includes a switch T2C and a switch T2D. The switch T2C has a first terminal for receiving the default voltage OVDD, a second terminal coupled to the first terminal S of the driving transistor T2B, and a control terminal for receiving the emission control signal EM. The switch T2D has a first terminal for receiving the default voltage OVDD, a second terminal coupled to the compensation circuit 230, and a control terminal for receiving the emission control signal EM.

In some embodiments of the present disclosure, the compensation circuit comprises a capacitor C2, a switch T2E, and a switch T2F. The capacitor C2 has a first terminal coupled to the second terminal of the switch T2D, and a second terminal coupled to the control terminal G of the driving transistor T2B. The switch T2E has a first terminal for receiving the reference voltage Vref, a second terminal coupled to the first terminal of the capacitor C2 and the second terminal of the switch T2D, and a control terminal for receiving the second control signal SN2. The switch T2F has a first terminal coupled to the second terminal of the capacitor C2, a second terminal coupled to the second terminal D of the driving transistor T2B, and a control terminal for receiving the second control signal SN2.

The discharge circuit comprises a switch T2G. The switch T2G has a first terminal for receiving the initial voltage Vini, a second terminal coupled to the second terminal D of the driving transistor T2B, and a control terminal for receiving the third control signal SN3.

In some embodiments of the present disclosure, the switches T2A and T2C to T2G and the driving transistor T2B can be P type transistors, the default voltage OVSS is smaller than the default voltage OVDD, and the second terminal of the organic light emitting diode 210 is a cathode of the organic light emitting diode 210. However, the present disclosure is not limited to use P type transistors; in other embodiments of the present disclosure, switches T2A and T2C to T2G and the driving transistor T2B can also be N type transistors.

Figure 8:
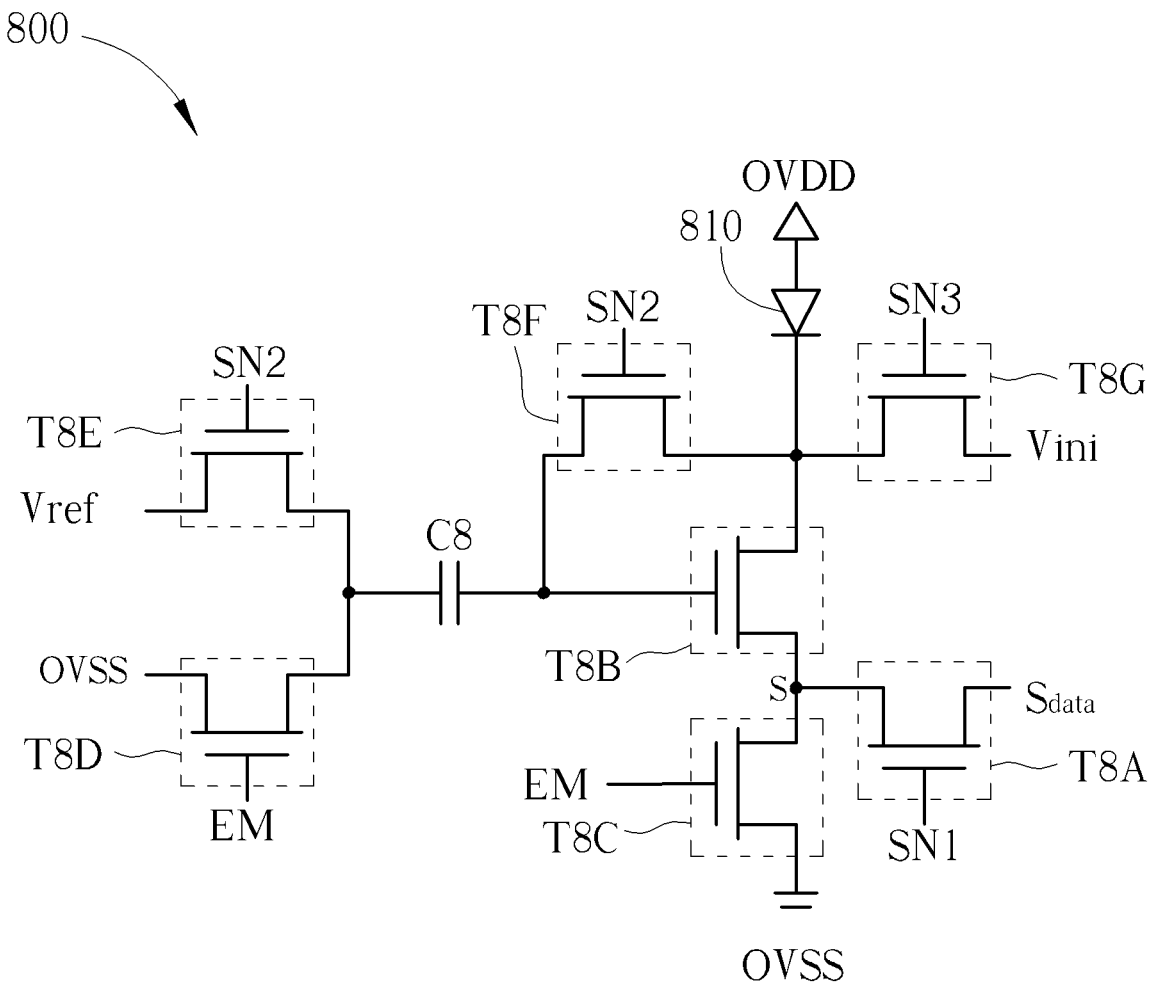
FIG. 8 shows a pixel control circuit according to another embodiment of the present disclosure.

FIG. 8 shows a pixel control circuit 800 according to one embodiment of the present disclosure. The structure of the pixel control circuit 800 is similar to the structure of the pixel control circuit 200. The switches T8A and T8C to T8G can be corresponding to the switches T2A and T2C to T2G respectively, the driving transistor T8B can be corresponding to the driving transistor T2B, and the capacitor C8 can be corresponding to the capacitor C2. The difference between these two pixel control circuits is that the switches T8A and T8C to T8G and the driving transistor T8B are N type transistors, the first terminal of the switch T8C receives the default voltage OVSS, the first terminal of the switch T8D receives the default voltage OVSS, and the second terminal of the organic light emitting diode 810 receives the default voltage OVDD, namely, in the embodiment in FIG. 8, the second terminal of the organic light emitting diode 810 is the anode of the organic light emitting diode 810. The pixel control circuit 800 may have the same operational timing as the pixel control circuit 200. However, the control signals for the pixel control circuit 800 are complementary to the control signals for the pixel control circuit 200.

Figure 3:
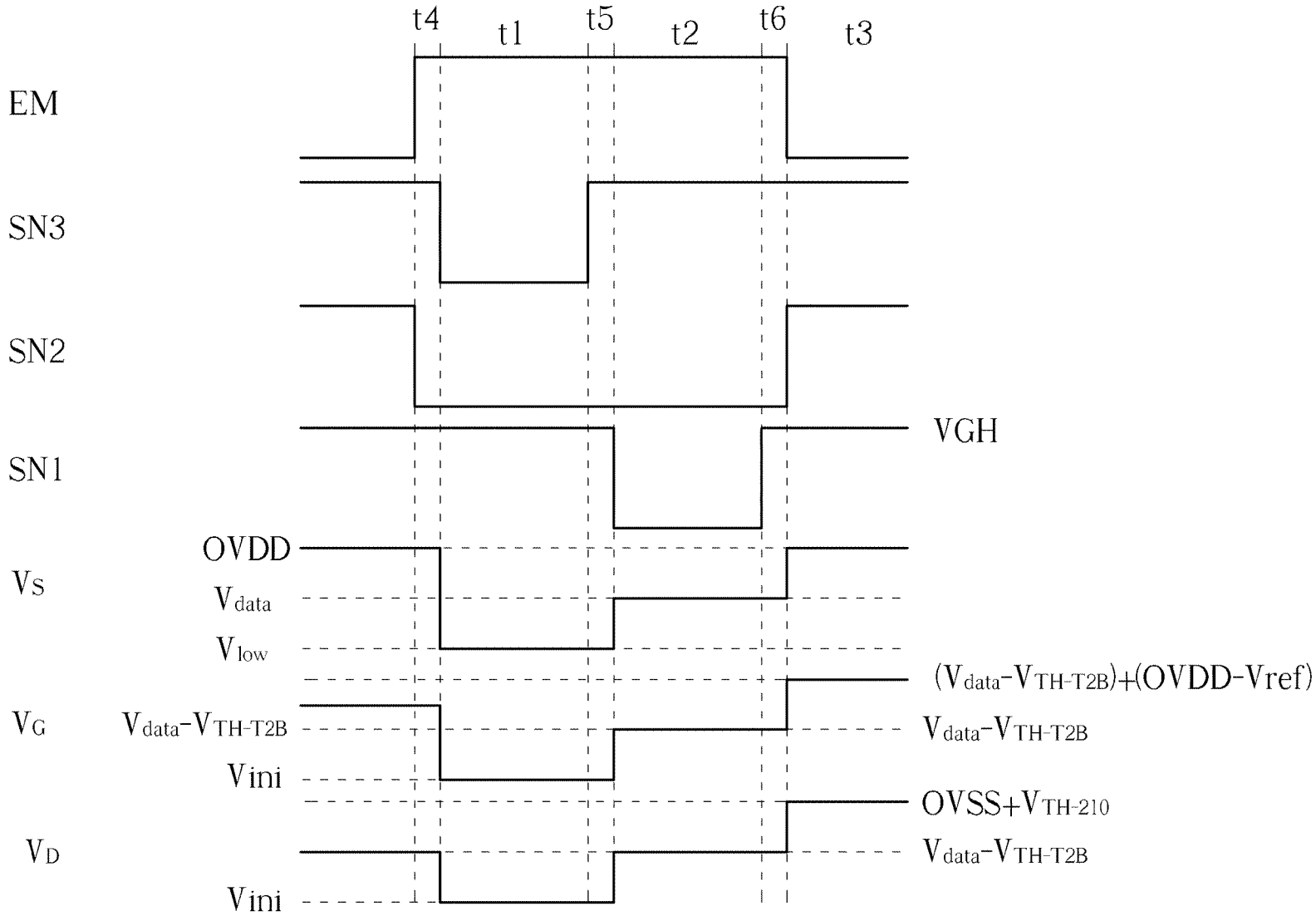
FIG. 3 shows a timing diagram of the pixel control circuit in FIG. 2.

FIG. 3 shows a timing diagram of the pixel control circuit 200. For the purpose of convenience, the timing diagram in FIG. 3 shows the timing with the switches T2A and T2C to T2G and the driving transistor T2B to be P type transistors exemplarily.

Since the first control signal SN1, the emission control signal EM, the second control signal SN2, and the third control signal SN3 that control the switches T2A, T2C, T2D, T2E, T2F, and T2G are all digital signals, these signals are able to fully turn on and fully turn off the switches T2A, T2C, T2D, T2E, T2F, and T2G, and, thus, variation of the threshold voltages of the switches T2A, T2C, T2D, T2E, T2F, and T2G may have smaller influences on the amount of current. Contrarily, since the driving transistor T2B is controlled by the data signal $S_{data}$, which is an analog signal, for conducting different amounts of current according to the voltage level of the data signal $S_{data}$. Therefore, in some embodiments of the present disclosure, the adjustment for the influences caused by the threshold voltage of the driving transistor T2B is considered firstly.

During the first duration t1, the emission control signal EM is at a high voltage VGH, the first control signal SN1 is at the high voltage VGH, the second control signal SN2 is at a low voltage VGL, and the third control signal SN3 is at the low voltage VGL. In this duration, the switches T2A, T2C and T2D are turned off. The switch T2G is turned on so a voltage $V_D$ of the second terminal D of the driving transistor T2B, that is, a voltage of the first terminal of the organic light emitting diode 210, is pulled down to the initial voltage Vini. In some embodiments of the present disclosure, the initial voltage Vini is smaller than a sum of the default voltage OVSS and a threshold voltage $V_{TH\text{-}210}$ of the organic light emitting diode 210. Consequently, the switch T2G of the discharge circuit 240 is able to conduct a path connecting to the initial voltage Vini according to the third control signal SN3 for providing the organic light emitting diode 210 with a discharge path to discharge the remaining charges stored in the previous operation, and to turn off the organic light emitting diode 210 effectively. The remaining charges stored at the first terminal S of the driving transistor T2B stored in the previous operation can also be discharged through the path provided by the switch T2G so that the voltage $V_S$ of the first terminal S of the driving transistor T2B can also be pulled down to a low voltage $V_{low}$ lower than the previous voltage. The switches T2E and T2F are both turned on so a voltage of the first terminal of the capacitor C2 is at the reference voltage Vref, and a voltage of second terminal of the capacitor C2, that is, the voltage $V_G$ of the control terminal G of the driving transistor T2B, can be controlled at the initial voltage Vini by the switches T2F and T2G.

During a second duration t2 after the first duration t1, the emission control signal EM is at the high voltage VGH, the first control signal SN1 is at the low voltage VGL, the second control signal SN2 is at the low voltage VGL, and the third control signal SN3 is at the high voltage VGH. In this duration, the switches T2C, T2D, and T2G are turned off. The switch T2A is turned on so the voltage $V_S$ of the first terminal of the driving transistor T2B is at the voltage $V_{data}$ of the data signal $S_{data}$. The switch T2E is turned on so that the voltage of the first terminal of the capacitor C2 remains at the reference voltage Vref, and the voltage of the second terminal of the capacitor C2, that is, the voltage $V_G$ of the control terminal G of the driving transistor T2B, is at a lower voltage firstly. In some embodiments of the present disclosure, the initial voltage Vini in the first duration t1 is not greater than a difference between a minimum voltage $V_{datamin}$ of the data signal $S_{data}$ (ex., the voltage of the data signal $S_{data}$ when the image data is white) and an absolute value of the threshold voltage $V_{TH-T2B}$ of the driving transistor T2B, that is, $V_{datamin}-|V_{TH-T2B}|$. Therefore, the driving transistor T2B is turned on, making the voltage $V_D$ of the second terminal D of the driving transistor T2B at the voltage $V_{data}$ of the data signal $S_{data}$ minus the absolute value of the threshold voltage $V_{TH-T2B}$ of the driving transistor T2B, that is, $V_{data}-|V_{TH-T2B}|$. Since the switch T2F is turned on, the voltage $V_G$ of the control terminal G of the driving transistor T2B is kept at the same voltage as the voltage of the second terminal D of the driving transistor T2B, that is, $V_{data}-|V_{TH-T2B}|$.

During a third duration t3 after the second duration t2, the emission control signal EM is at the low voltage VGL, the first control signal SN1 is at the high voltage VGH, the second control signal SN2 is at the high voltage VGH, and the third control signal SN3 is at the high voltage VGH. In this duration, the switches T2A, T2E, T2F, and T2G are all turned off. Since the switch T2D is turned on, the voltage of the first terminal of the capacitor C2 is changed from the reference voltage Vref to the default voltage OVDD. Since there is no discharging path around the capacitor C2, the voltage of the second terminal of the capacitor C2, that is the voltage $V_G$ of the control terminal G of the driving transistor T2B, is coupled as shown in equation (1):

$$V_G=(V_{data}-|V_{TH-T2B}|)+(OVDD-V\text{ref}) \quad (1)$$

Since the switch T2C is turned on, the voltage $V_S$ of the first terminal S of the driving transistor T2B is pulled up to the default voltage OVDD. Since the turned-on switch T2C and the driving transistor T2B can turn on the organic light emitting diode 210, the voltage $V_D$ of the second terminal D of the driving transistor T2B is substantially equal to a sum of the default voltage OVSS and the threshold voltage $V_{TH-210}$ of the organic light emitting diode 210. In this case, the source to gate voltage $V_{SG}$ of the driving transistor T2B is represented as equation (2):

$$V_{SG}=V_S-V_G=OVDD-[(V_{data}-|V_{TH-T2B}|)+(OVDD-V\text{ref})]=V\text{ref}-(V_{data}-V_{TH-T2B}) \quad (2)$$

If equation (2) is substituted in the transistor current equation, then the current $I_{T2B}$ flowing through the driving transistor T2B can be represented as equation (3):

$$I_{T2B}=K(V_{SG}-|V_{TH-T2B}|)^2=K[V\text{ref}-(V_{data}-|V_{TH-T2B}|)-|V_{TH-T2B}|]^2=K(V\text{ref}-V_{data}) \quad (3)$$

K represents the manufacturing parameter of the driving transistor T2B. Since the reference voltage Vref is a default fixed value, the current $I_{T2B}$ flowing through the driving transistor T2B can be independent from the threshold voltage $V_{TH-T2B}$ of the driving transistor T2B and the default voltage OVDD. In some embodiments of the present disclosure, to turn off the transistor T2B effectively when the data signal $S_{data}$ has a maximum voltage $V_{datamax}$ (ex., the voltage of the data signal $S_{data}$ when the image data is black), the reference voltage Vref should be able to satisfy equation (4):

$$V_{gate-T2B}\leq(V_{datamax}-|V_{TH-T2B}|)+(OVDD-V\text{ref}) \quad (4)$$

$V_{gate-T2B}$ represents a turn off voltage of the driving transistor T2B, that is, when the gate voltage $V_G$ of the driving transistor T2B is greater than the turn off voltage $V_{gate-T2B}$ of the driving transistor T2B, the driving transistor T2B will be turned off. According to equation (4), equation (5) can be derived as:

$$V\text{ref}\leq(V_{datamax}-|V_{TH-T2B}|)+(OVDD-V_{gate-T2B}) \quad (5)$$

According to equation (5), the reference voltage Vref is not greater than a sum of a difference between the maximum voltage $V_{datamax}$ of the data signal $S_{data}$ and the absolute value of the threshold voltage $|V_{TH-T2B}|$ of the driving transistor T2B and a difference between the default voltage OVDD and the turn off voltage $V_{gate-T2B}$ of the driving transistor T2B. Consequently, when using the pixel control circuit 200 to control pixels in a display, the nonuniformity of brightness of the image caused by different characteristics of transistors in each of the pixels and different default voltages OVDD received by each of the pixels can be avoided, and the image quality of the display can be improved. In addition, since the discharge circuit 240 can provide a discharging path in the second duration t2, the issue of the black image being not dark enough, which caused by the remaining charges in the pixels, can also be solved.

In some embodiments of the present disclosure, during a fourth duration t4 before the first duration t1, the emission control signal EM is at the high voltage VGH, the first control signal SN1 is at the high voltage VGH, the second control signal SN2 is at the low voltage VGL, and the third control signal SN3 is at the high voltage VGH. When the third control signal SN3 changes from the high voltage VGH to the low voltage VGL, it will enter into the first duration t1 from the fourth duration t4.

In some embodiments of the present disclosure, during a fifth duration t5 between the first duration t1 and the second duration t2, the emission control signal EM is at the high voltage VGH, the first control signal SN1 is at the high voltage VGH, the second control signal SN2 is at the low voltage VGL, and the third control signal SN3 is at the high voltage VGH. When the first control signal SN1 changes from the high voltage VGH to the low voltage VGL, it will enter into the second duration t2 from the fifth duration t5.

In some embodiments of the present disclosure, during a sixth duration t6 between the second duration t2 and the third duration t3, the emission control signal EM is at the high voltage VGH, the first control signal SN1 is at the high voltage VGH, the second control signal SN2 is at the low voltage VGL, and the third control signal SN3 is at the high voltage VGH. When the emission control signal EM changes from the high voltage VGH to the low voltage VGL, it will enter into the third duration t3 from the sixth duration t6.

Figure 4:
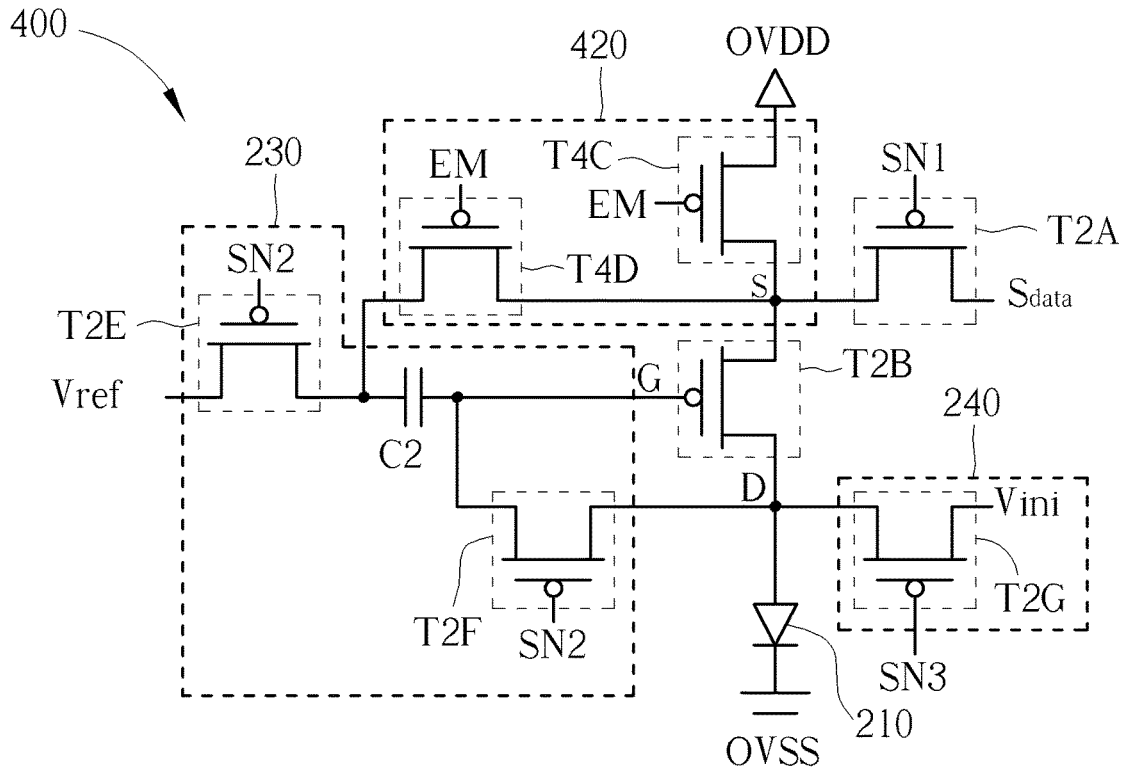
FIG. 4 shows a pixel control circuit according to another embodiment of the present disclosure.

FIG. 4 shows a pixel control circuit 400 according to one embodiment of the present disclosure. The pixel control circuit 400 and the pixel control circuit 200 have similar structures and operation principles. The difference between these two pixel control circuits is that the driving circuit 420 of the pixel control circuit 400 includes the switches T4C and T4D. The switch T4C has a first terminal for receiving the default voltage OVDD, a second terminal coupled to the first terminal S of the driving transistor T2B, and a control terminal for receiving the emission control signal EM. The switch T4D has a first terminal coupled to the second terminal of the switch T4C, a second terminal coupled to first terminal of the capacitor C2 of the compensation circuit 230, and a control terminal for receiving the emission control signal EM.

Since the operation principles of the pixel control circuits 400 and 200 are similar, the timing diagram of the pixel control circuit 400 is same as FIG. 3. Since the switches T4C and T4D are turned off during the first duration t1 and the second duration t2, the pixel control circuit 400 has the same operations as the aforesaid operations. As in the third duration t3, the switches T4C and T4D are both turned on so the voltage of the second terminal of the switch T4D is pulled up to the default voltage OVDD and the voltage of the first terminal of the capacitor C2 changes from the reference voltage Vref to the default voltage OVDD. Therefore, the voltage $V_G$ of the control terminal G of the driving transistor T2B in the pixel control circuit 400 can still be represented as $(V_{data}-V_{TH-T2B})+(OVDD-Vref)$ as shown in FIG. 3, and the voltage $V_S$ of the first terminal S of the driving transistor T2B is at the default voltage OVDD so that the current $I_{T2B}$ flowing through the driving transistor T2B is still independent from the threshold voltage $V_{TH-T2B}$ of the driving transistor T2B and the default voltage OVDD.

Consequently, when using the pixel control circuit 400 to control pixels in a display, the nonuniformity of brightness of the image caused by different characteristics of transistors in each of the pixels and different default voltages OVDD received by each of the pixels can be avoided, and the image quality of the display can be improved.

Figure 5:
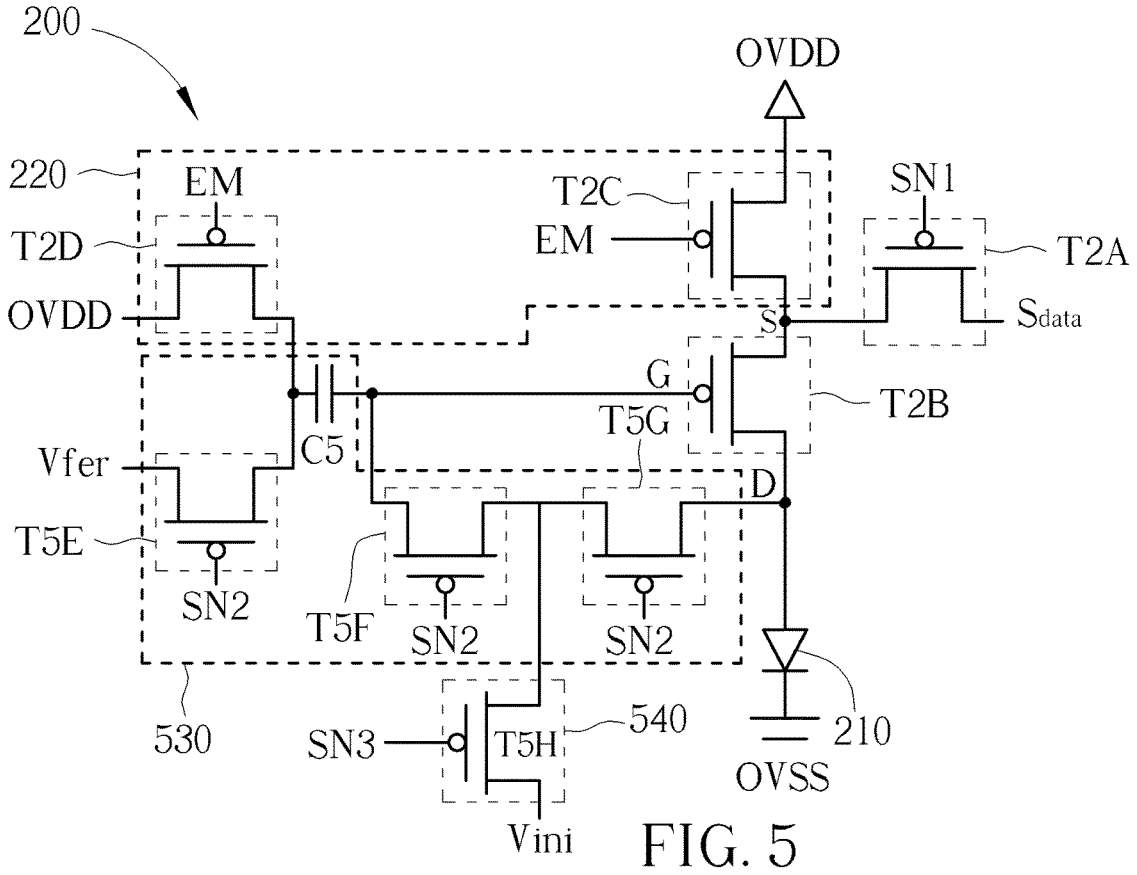
FIG. 5 shows a pixel control circuit according to another embodiment of the present disclosure.

FIG. 5 shows a pixel control circuit 500 according to one embodiment of the present disclosure. The pixel control circuit 500 and the pixel control circuit 200 have similar structures and operation principles. The difference between these two pixel control circuits is in the compensation circuit 530 and the discharge circuit 540 of the pixel control circuit 500. The compensation circuit 530 includes a capacitor C5, a switch T5E, a switch T5F, and a switch T5G. The capacitor C5 has a first terminal coupled to the second terminal of the switch T2D, and a second terminal coupled to the control terminal G of the driving transistor T2B. The switch T5E has a first terminal for receiving the reference voltage Vref, a second terminal coupled to the first terminal of the capacitor C5, and a control terminal for receiving the second control signal SN2. The switch T5F has a first terminal coupled to the second terminal of the capacitor C5, a second terminal, and a control terminal for receiving the second control signal SN2. The switch T5G has a first terminal coupled to the second terminal of the switch T5F, a second terminal coupled to the second terminal D of the driving transistor T2B, and a control terminal for receiving the second control signal SN2.

The discharge circuit 540 includes a switch T5H. The switch T5H has a first terminal for receiving the initial voltage Vini, a second terminal coupled to the first terminal of the switch T5G, and a control terminal for receiving the third control signal SN3.

Since the operation principles of the pixel control circuits 500 and 200 are similar, the timing diagram of the pixel control circuit 500 is same as FIG. 3.

During the first duration t1 in FIG. 3, the switches T2A, T2C and T2D are turned off. The switches T5G and T5H are turned on so the voltage $V_D$ of the second terminal D of the driving transistor T2B is pulled down to the initial voltage Vini. Consequently, the switch T5H of the discharge circuit 540 is able to conduct a path connecting to the initial voltage Vini according to the third control signal SN3 for providing the organic light emitting diode 210 with a discharge path to discharge the remaining charges stored in the previous operation, and to turn off the organic light emitting diode 210 effectively. The remaining charges stored at the first terminal S of the driving transistor T2B stored in the previous operation can also be discharged through the path provided by the switches T5G and T5H so that the voltage $V_S$ of the first terminal S of the driving transistor T2B can also be pulled down to the low voltage $V_{low}$ lower than the previous voltage. The switches T5E and T5F are both turned on so a voltage of the first terminal of the capacitor C5 is at the reference voltage Vref, and a voltage of second terminal of the capacitor C5, that is, the voltage $V_G$ of the control terminal G of the driving transistor T2B, can be controlled at the initial voltage Vini by the switches T5F and T5H.

During a second duration t2, the switches T2C, T2D, and T5H are turned off. The switch T2A is turned on so the voltage $V_S$ of the first terminal of the driving transistor T2B is at the voltage $V_{data}$ of the data signal $S_{data}$. The switch T5E is turned on so that the voltage of the first terminal of the capacitor C5 remains at the reference voltage Vref, and the voltage of the second terminal of the capacitor C5, that is, the voltage $V_G$ of the control terminal G of the driving transistor T2B, is at a lower voltage firstly so the driving transistor T2B is turned on and the voltage $V_D$ of the second terminal D of the driving transistor T2B is at the voltage $V_{data}$ of the data signal $S_{data}$ minus the absolute value of the threshold voltage $V_{TH-T2B}$ of the driving transistor T2B, that is, $V_{data}-|V_{TH-T2B}|$. Since the switches T5F and T5G are turned on, the voltage $V_G$ of the control terminal of the driving transistor T2B remains at the same voltage as the voltage $V_D$ of the second terminal D of the driving transistor T2B, that is, $V_{data}-|V_{TH-T2B}|$.

During a third duration t3 the switches T2A, T5E, T5F, T5G, and T5H are all turned off. Since the driving transistor T2B and the switches T2C and T2D are all turned on, the voltage of the first terminal of the capacitor C5 is changed from the reference voltage Vref to the default voltage OVDD. Consequently, the voltage $V_G$ of the control terminal G of the driving transistor T2B in pixel control circuit 500 is at $(V_{data}-V_{TH-T2B})+(OVDD-Vref)$ as shown in FIG. 3, and the voltage $V_S$ of the first terminal S of the driving transistor T2B is at the default voltage OVDD so that the current $I_{T2B}$ flowing through the driving transistor T2B is still independent from the threshold voltage $V_{TH-T2B}$ of the driving transistor T2B and the default voltage OVDD.

Consequently, when using the pixel control circuit 500 to control pixels in a display, the nonuniformity of brightness of the image caused by different characteristics of transistors in each of the pixels and different default voltages OVDD received by each of the pixels can be avoided, and the image quality of the display can be improved.

In some embodiments of the present disclosure, the driving circuit 220 of the pixel control circuit 500 can also be replaced by the driving circuit 420 of the pixel control circuit 400 and can still achieve the same effect.

Figure 6:
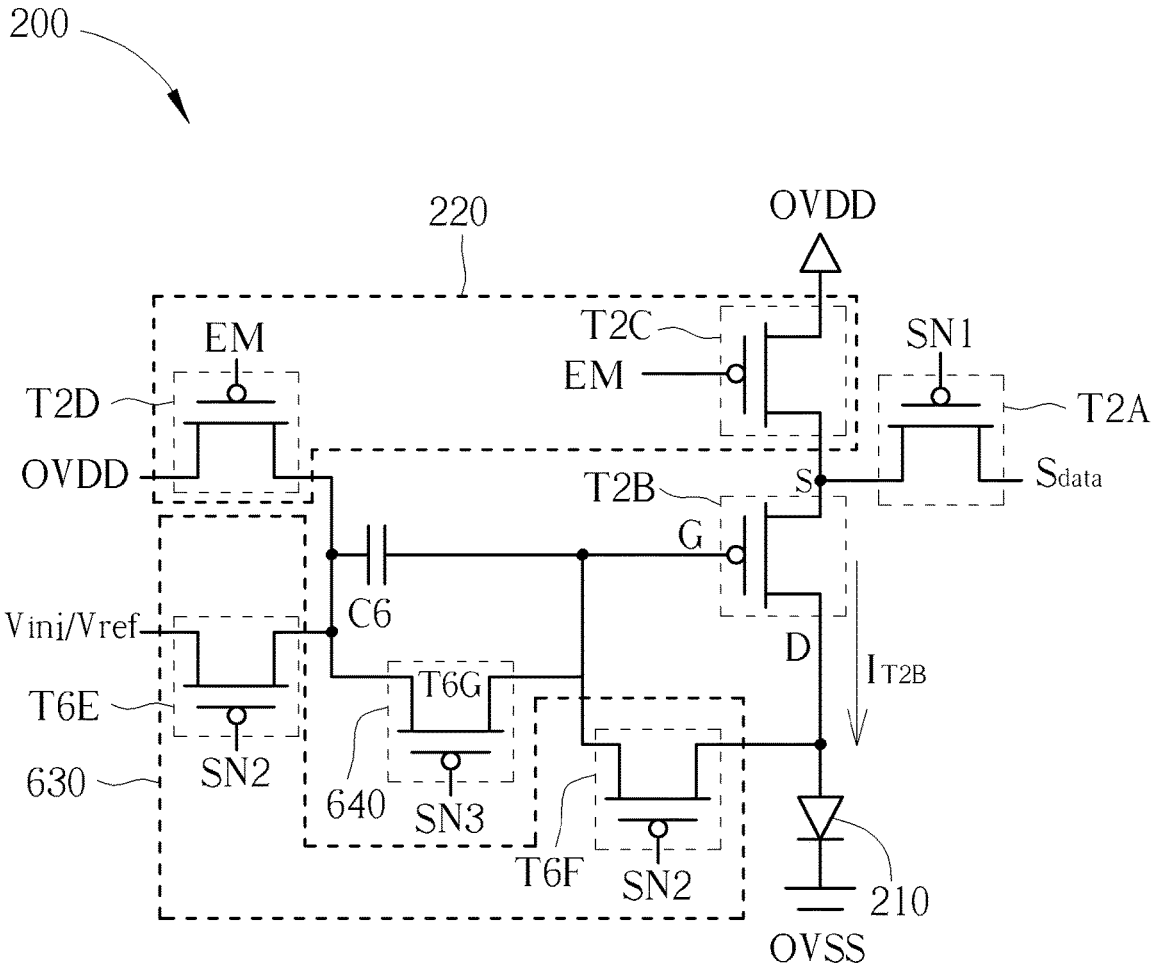
FIG. 6 shows a pixel control circuit according to another embodiment of the present disclosure.

FIG. 6 shows a pixel control circuit 600 according to one embodiment of the present disclosure. The pixel control circuit 600 and the pixel control circuit 200 have similar structures and operation principles. The difference between these two pixel control circuits is in the compensation circuit 630 and the discharge circuit 640 of the pixel control circuit 600. Since the operation principles of the pixel control circuits 600 and 200 are similar, the timing diagram of the pixel control circuit 600 is same as FIG. 3.

The compensation circuit 630 includes a capacitor C6, and switches T6E and T6F. The capacitor C6 has a first terminal coupled to the second terminal of the switch T2D, and a second terminal coupled to the control terminal G of the driving transistor T2B. The switch T6E has a first terminal for receiving the initial voltage Vini during the first duration t1 in FIG. 3 and receiving the reference voltage Vref during the second duration t2 and the third duration t3, a second terminal coupled to the first terminal of the capacitor C6, and a control terminal for receiving the second control signal SN2. The switch T6F has a first terminal coupled to the second terminal of the capacitor C6, a second terminal coupled to the second terminal D of the driving transistor T2B, and a control terminal for receiving the second control signal SN2.

The discharge circuit 640 includes a switch T6G. The switch T6G has a first terminal coupled to the second terminal of the switch T6E, a second terminal coupled to the first terminal of the switch T6F, and a control terminal for receiving the third control signal SN3.

During the first duration t1 in FIG. 3, the switches T2A, T2C and T2D of the pixel control circuit 600 are turned off. The switches T6E, T6F and T6G are turned on and the first terminal of the switch T6E receives the initial voltage Vini so the voltage $V_D$ of the second terminal D of the driving transistor T2B is pulled down to the initial voltage Vini. Consequently, the switch T6G of the discharge circuit 640 is able to conduct a path connecting to the initial voltage Vini according to the third control signal SN3 for providing the organic light emitting diode 210 with a discharge path to discharge the remaining charges stored in the previous operation, and to turn off the organic light emitting diode 210 effectively. The remaining charges stored at the first terminal S of the driving transistor T2B stored in the previous operation can also be discharged through the path provided by the switches T6E, T6F and T6G so that the voltage $V_S$ of the first terminal S of the driving transistor T2B can also be pulled down to the low voltage $V_{low}$ lower than the previous voltage. A voltage of the first terminal of the capacitor C6 and a voltage of the second terminal of the capacitor C6 are controlled at the initial voltage Vini by the switches T6E and T6G so the voltage $V_G$ of the control terminal G of the driving transistor T2B is also at the initial voltage Vini.

During a second duration t2, the switches T2C, T2D, and T6G are turned off. The switch T2A is turned on so the voltage $V_S$ of the first terminal of the driving transistor T2B is at the voltage $V_{data}$ of the data signal $S_{data}$. The switch T6E is turned on and the first terminal of the switch T6E receives the reference voltage Vref so that the voltage of the first terminal of the capacitor C6 is at the reference voltage Vref, and the voltage of the second terminal of the capacitor C6, that is, the voltage $V_G$ of the control terminal G of the driving transistor T2B, is at a lower voltage firstly so the driving transistor T2B is turned on and the voltage $V_D$ of the second terminal D of the driving transistor T2B is at the voltage $V_{data}$ of the data signal $S_{data}$ minus the absolute value of the threshold voltage $V_{TH\text{-}T2B}$ of the driving transistor T2B, that is, $V_{data}-|V_{TH\text{-}T2B}|$. Since the switches T6F is turned on, the voltage $V_G$ of the control terminal G of the driving transistor T2B remains at the same voltage as the voltage $V_D$ of the second terminal D of the driving transistor T2B, that is, $V_{data}-|V_{TH\text{-}T2B}|$.

During a third duration t3, the switches T2A, T6E, T6F, and T6G are all turned off. Since the driving transistor T2B and the switches T2C and T2D are all turned on, the voltage of the first terminal of the capacitor C6 is changed from the reference voltage Vref to the default voltage OVDD. Consequently, the voltage $V_G$ of the control terminal G of the driving transistor T2B in pixel control circuit 600 is at $(V_{data}-V_{TH\text{-}T2B})+(OVDD-Vref)$ as shown in FIG. 3, and the voltage $V_S$ of the first terminal S of the driving transistor T2B is at the default voltage OVDD so that the current $I_{T2B}$ flowing through the driving transistor T2B is still independent from the threshold voltage $V_{TH\text{-}T2B}$ of the driving transistor T2B and the default voltage OVDD.

Consequently, when using the pixel control circuit 600 to control pixels in a display, the nonuniformity of brightness of the image caused by different characteristics of transistors in each of the pixels and different default voltages OVDD received by each of the pixels can be avoided, and the image quality of the display can be improved.

In some embodiments of the present disclosure, the driving circuit 220 of the pixel control circuit 600 can also be replaced by the driving circuit 420 of the pixel control circuit 400 and can still achieve the same effect.

Figure 7:
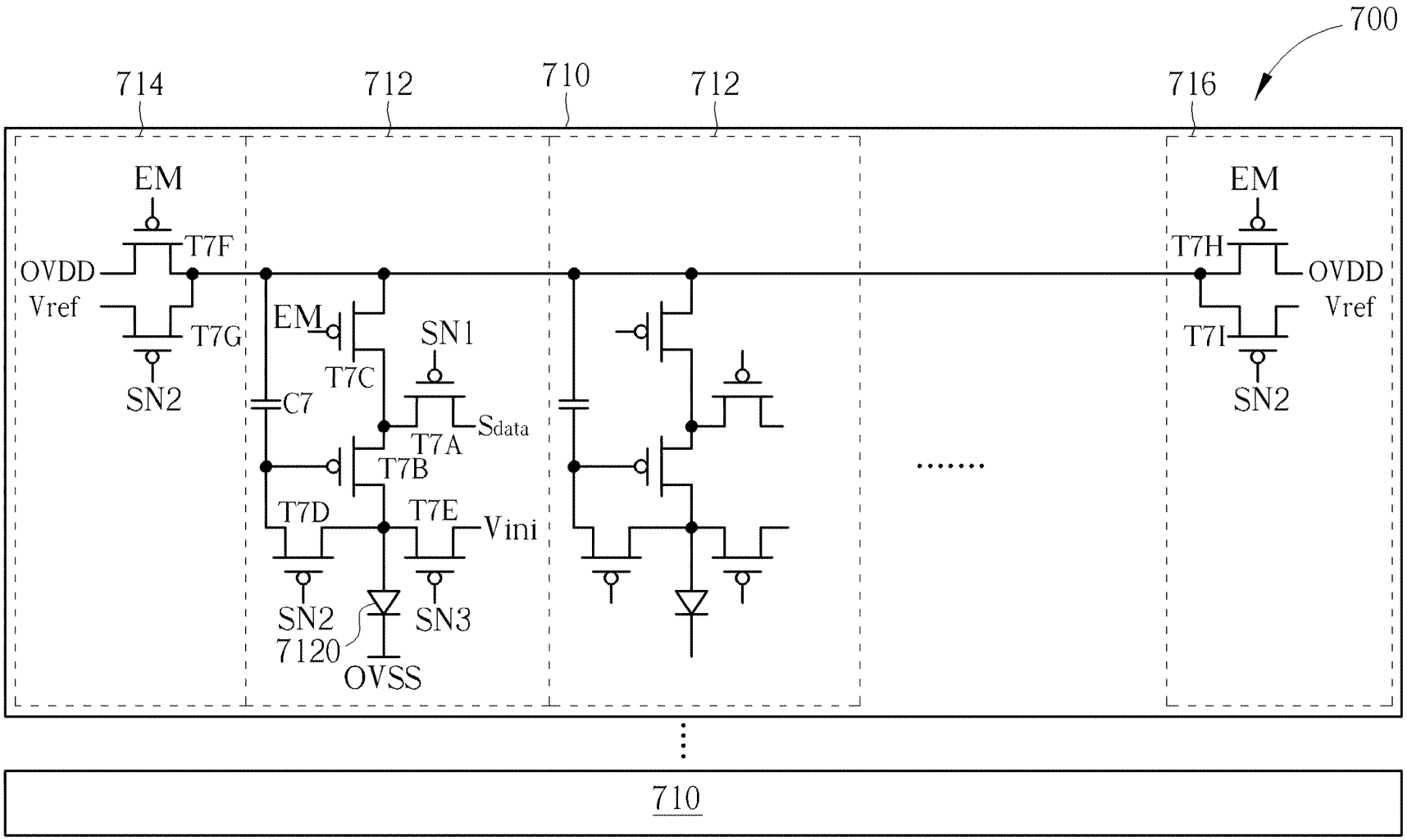
FIG. 7 shows a pixel array control circuit according to one embodiment of the present disclosure.

When using the pixel control circuit 200 to control pixels, since pixels in the same row have the same operation timing, it is possible to adopt a share circuit to save the number of switches and to reduce the area of the pixel array control circuit. FIG. 7 shows a pixel array control circuit 700. The pixel array control circuit 700 includes at least one row pixel control circuit 700. Each of the row pixel control circuit 700 includes a plurality of pixel control circuits 712 and a share circuit 714. Each pixel control circuit 712 includes an organic light emitting diode 7120, a capacitor C7, a driving transistor T7B, and switches T7A, T7C, T7D, and T7E. The organic light emitting diode 7120 has a first terminal, and a second terminal for receiving a default voltage OVSS. The switch T7A has a first terminal for receiving the data signal $S_{data}$, a second terminal, and a control terminal for receiving the first control signal SN1. The driving transistor T7B has a first terminal coupled to the second terminal of the switch T7A, a second terminal coupled to the first terminal of the organic light emitting diode 7120, and a control terminal. The switch T7C has a first terminal, a second terminal coupled to the first terminal of the driving transistor T7B, and a control terminal for receiving the emission control signal EM. The capacitor C7 has a first terminal coupled to the first terminal of the switch T7C, and a second terminal coupled to the control terminal of the driving transistor T7B. The switch T7D has a first terminal coupled to the second terminal of the capacitor C7, a second terminal coupled to the second terminal of the driving transistor T7B, and a control terminal for receiving the second control signal SN2. The switch T7E has a first terminal for receiving the initial voltage Vini, a second terminal coupled to the second terminal of the driving transistor T7B, and a control terminal for receiving the third control signal SN3.

The share circuit 714 includes switches T7F and T7G. The switch T7F has a first terminal for receiving the default voltage OVDD, a second terminal coupled to the first terminal of the switch T7C, and a control terminal for receiving the emission control signal EM. The switch T7G has a first terminal for receiving the reference voltage Vref, a second terminal coupled to the first terminal of the switch T7C, and a control terminal for receiving the second control signal SN2. The combination of the pixel control circuit 712 and the share circuit 714 can have the same operation principles as the pixel control circuit 200 in FIG. 2 does. That is, the switch T7A can be corresponding to the switch T2A, the driving transistor T7B can be corresponding to the driving transistor T7B, the switch T7C can be corresponding to the switch T2C, the switch T7D can be corresponding to the switch T2F, the switch T7E can be corresponding to the switch T2G, the switch T7F can be corresponding to the switch T2D, the switch T7G can be corresponding to the switch T2E. Although the first terminal of the switch T2C receives the default voltage OVDD directly while the first terminal of the switch T7C receives the default voltage OVDD through the switch T7F, since both the switches T7C and T7F are controlled by the emission control signal EM, the turned on switch T7F will allow the switch T7C to receive the default voltage OVDD when the switch T7C is also turned on. Therefore, by using the pixel control circuit 712 and the share circuit 714, the nonuniformity of brightness of the image caused by different characteristics of transistors in each of the pixels and different default voltages OVDD received by each of the pixels can be avoided, and the image quality of the display can be improved. Since the pixels in the same row have the same operation timing, pixels in the same row can share the same share circuit. Consequently, the pixel control circuit 712 of the pixel array control circuit 700 can be achieved by only five transistors, which can further save the area of the pixel control circuit. The area and cost saved by the pixel array control circuit 700 is even more significant especially when the resolution of the display grows or the number of pixels increases.

In some embodiments of the present disclosure, the pixel array control 700 may further include another share circuit 716. The share circuit 716 has the same structure and operation principles as the share circuit 714 does. The share circuit 716 includes switches T7H, and T7I. The switch T7H has a first terminal for receiving the default voltage OVDD, a second terminal coupled to the first terminal of the switch T7C, and a control terminal for receiving the emission control signal EM. The switch T7I has a first terminal for receiving the reference voltage Vref, a second terminal coupled to the first terminal of the switch T7C, and a control terminal for receiving the second control signal SN2. The share circuits 714 and 716 can be disposed at two different sides of a non-display region of the display so that the issue that the pixel control circuits 712 disposed at two different sides of the display receive the default voltage OVDD and reference voltage Vref differently caused by the line loss can be solved while the area of a display region of the display can be saved.

In some embodiments of the present disclosure, the switches T7A and T7C to T7G and the driving transistor T7B can be P type transistors, the default voltage OVSS is smaller than the default voltage OVDD, and the second terminal of the organic light emitting diode 7120 is a cathode of the organic light emitting diode 7120. However, the present disclosure is not limited to use P type transistors; in other embodiments of the present disclosure, switches T7A and T7C to T7G and the driving transistor T7B can also be N type transistors.

Figure 9:
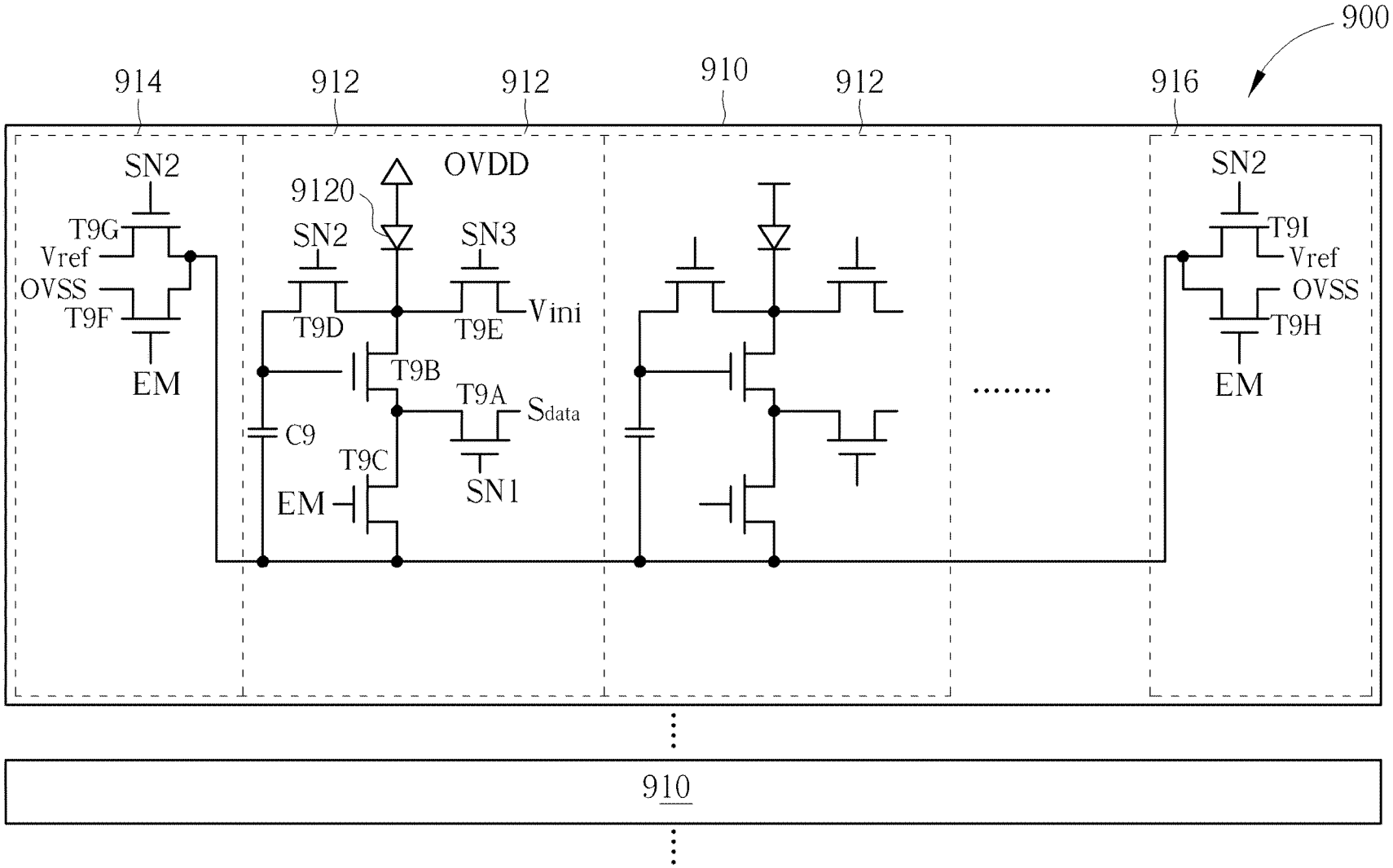
FIG. 9 shows a pixel array control circuit according to another embodiment of the present disclosure.

FIG. 9 shows a pixel array control circuit 900. The pixel array control circuit 900 has similar structure as the structure of the pixel array control circuit 700. The pixel array control circuit 900 includes at least one row pixel control circuit 910. Each of the row pixel control circuit 910 includes a plurality of pixel control circuit 912 and share circuits 914 and 916. Each pixel control circuit 912 includes an organic light emitting diode 9120, a capacitor C9, a driving transistor T9B, and switches T9A, T9C, T9D, and T9E. The share circuit 914 includes switches T9F and T9G, and the share circuit 916 includes the switches T9H and T9I. The driving transistor T9B can be corresponding to the driving transistor T7B, and the switches T9A and T9C to T9I can be corresponding to the switches T7A and T7C to T7I respectively. The difference between these two pixel array control circuits is that the driving transistor T9B and the switches T9A and T9C to T9I of the pixel array control circuit 900 are N type transistors. Since the control operation of N type transistors is complementary to the control operation of P type transistors, the first terminals of the switches T9F and T9H receive the default voltage OVSS, and the second terminal of the organic light emitting diode 9120 receives the default voltage OVDD, that is, in the embodiment of FIG. 9, the second terminal of the organic light emitting diode 9120 is the anode of the organic light emitting diode 9120.

Figure 1:
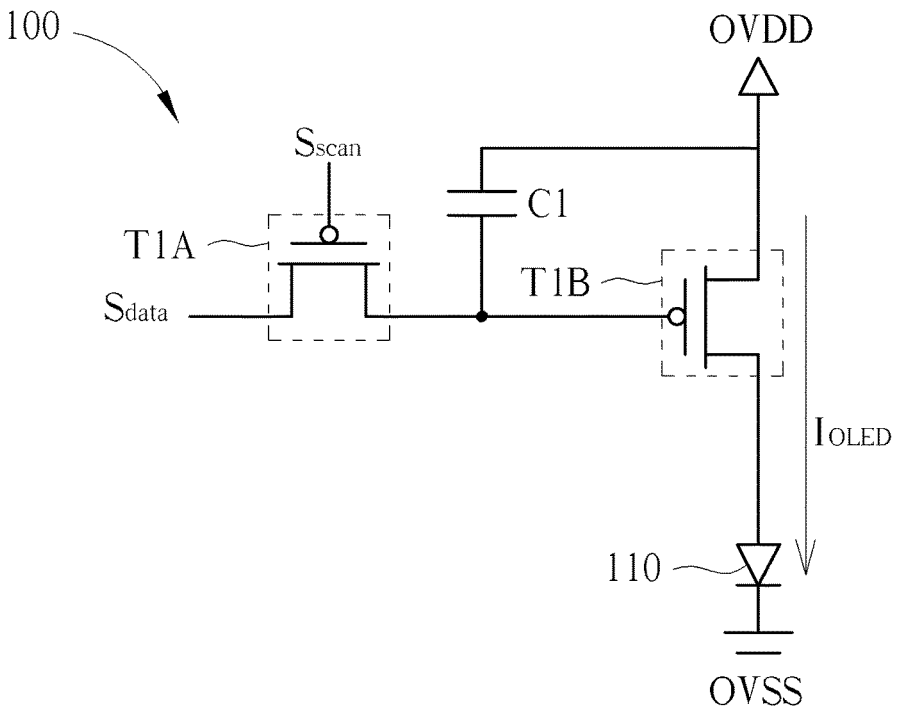
FIG. 1 PRIOR ART
FIG. 1 shows a pixel control circuit according to prior art.
Figure 10:
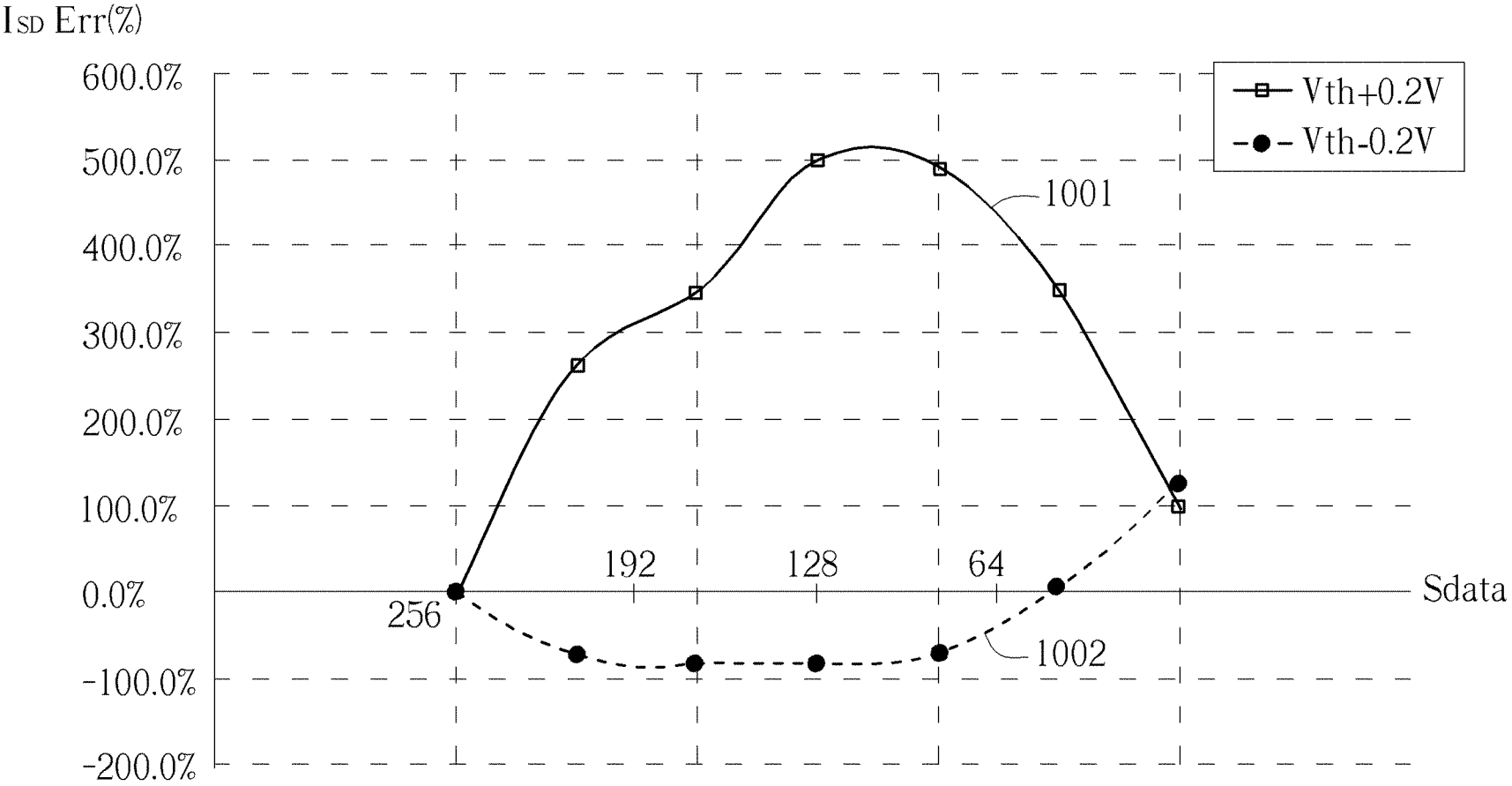
FIG. 10 shows a curve diagram of the data signal to current error according to the pixel control circuit in FIG. 1.

FIG. 10 shows a curve diagram of the data signal to current error according to the pixel control circuit 100 in FIG. 1. The horizontal axis of the curve diagram shows the data signal $S_{data}$ represented by grey scale, and the vertical axis of the curve diagram shows the current error $I_{SD}$Err in percentages (%). The curve 1001 shows the current error $I_{SD}$Err when the driving transistor T1B receives different values of the data signal $S_{data}$ with the threshold voltage$V_{TH-T2B}$ of the driving transistor T1B increasing by 0.2V due to parameter variation. The curve 1002 shows the current error $I_{SD}$Err when the driving transistor T1B receives different values of the data signal $S_{data}$ with the threshold voltage$V_{TH-T1B}$ of the driving transistor T1B decreasing by 0.2V due to parameter variation.

Figure 11:
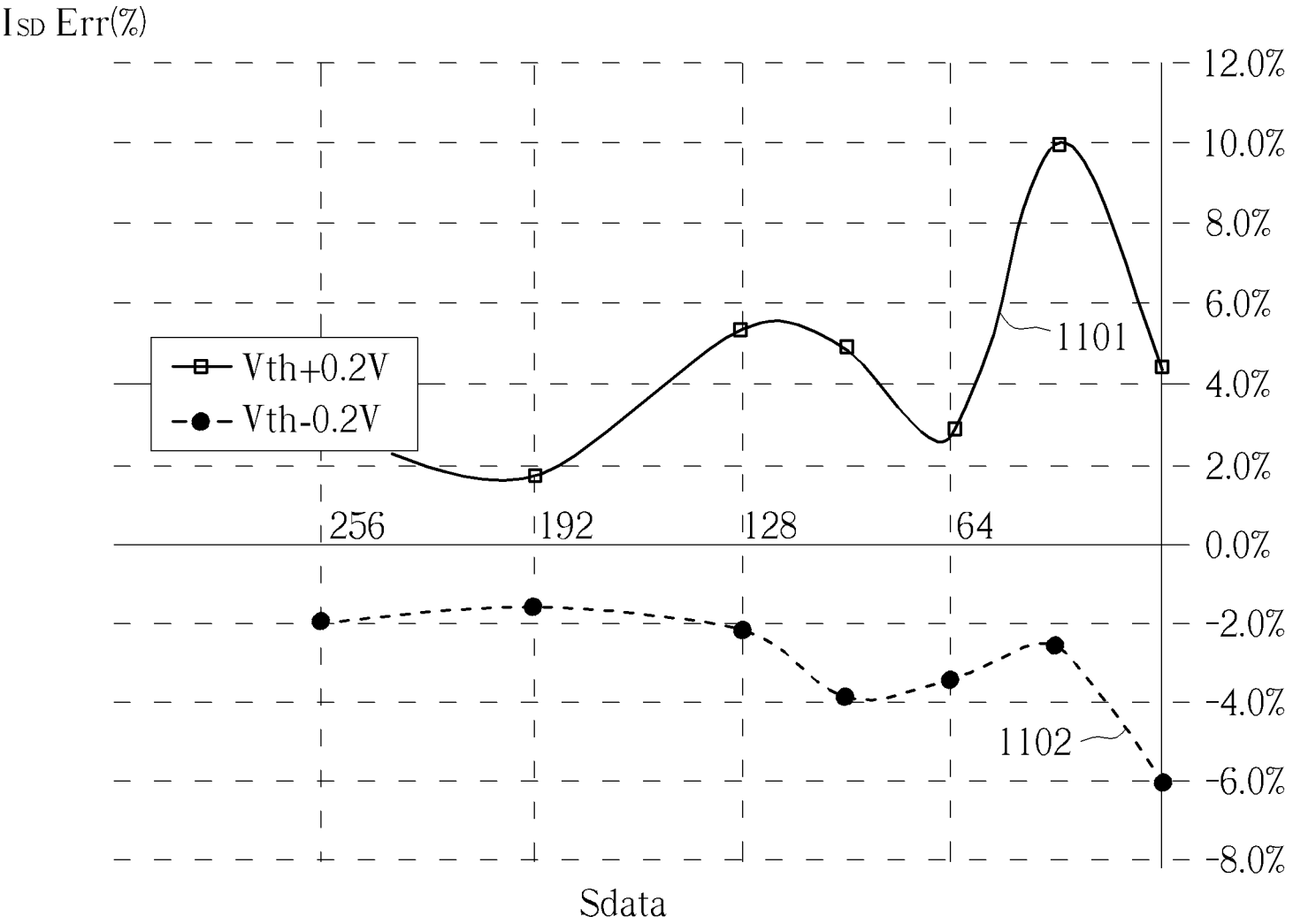
FIG. 11 shows a curve diagram of the data signal to current error according to the pixel control circuit in FIG. 7.

FIG. 11 shows a curve diagram of the data signal to current error according to the pixel control circuit 712 in FIG. 7. The horizontal axis of the curve diagram shows the data signal $S_{data}$ represented by grey scale, and the vertical axis of the curve diagram shows the current error $I_{SD}$Err in percentages (%). The curve 1101 shows the current error $I_{SD}$Err when the driving transistor T7B receives different values of the data signal $S_{data}$ with the threshold voltage$V_{TH-T7B}$ of the driving transistor T7B increasing by 0.2V due to parameter variation. The curve 1102 shows the current error $I_{SD}$Err when the driving transistor T7B receives different values of the data signal $S_{data}$ with the threshold voltage$V_{TH-T7B}$ of the driving transistor T7B decreasing by 0.2V due to parameter variation.

According to the comparison between FIG. 10 and FIG. 11, when receiving the data signals $S_{data}$ of same grey scale, the current error caused by the variation of the threshold voltage $V_{TH-T7B}$ of the driving transistor T7B in the pixel control circuit 712 is obviously smaller than the current error caused by the variation of the threshold voltage $V_{TH-T1B}$ of the driving transistor T1B in the pixel control circuit 100. For example, when the grey scale of the data signals $S_{data}$ is 64 and both of the threshold voltages of the driving transistors T1B and T7B are increasing by 0.2V due to parameter variation, the current error of the pixel control circuit 100 is over 400% while the current error of the pixel control circuit 712 is only about 5%. In addition, the maximum current error of the pixel control circuit can reach up to 500%, but the current error of the pixel control circuit 712 can be controlled within 10%. Therefore, according to the pixel control circuit and the pixel array control circuit in the embodiments of the present disclosure, the nonuniformity of brightness of the image caused by different characteristics of transistors in each of the pixels can be significantly eased and both the yield of the display and the image quality of the display can be improved.

In summary, the pixel control circuit and the pixel array control circuit can avoid the nonuniformity of brightness of the image caused by different characteristics of transistors in each of the pixels and different default voltages OVDD received by each of the pixels can be avoided, and the image quality of the display can be improved. Also, since the discharge circuits of the pixel control circuits in the aforesaid embodiments can provide discharging paths, the issue of the black image being not dark enough, which caused by the remaining charges in the pixels, can also be solved. The pixel control circuits can further combined with the share circuit to be a pixel array pixel control circuit according to the embodiments of the present disclosure to save the circuit area.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A pixel control circuit, comprising:

an organic light emitting diode having a first terminal, and a second terminal configured to receive a first default voltage;

a first switch having a first terminal configured to receive a data signal, a second terminal, and a control terminal configured to receive a first control signal;

a driving transistor having a first terminal coupled to the second terminal of the first switch, a second terminal coupled to the first terminal of the organic light emitting diode, and a control terminal;

a driving circuit coupled to the first terminal of the driving transistor, and configured to receive a second default voltage and control an electrical connection between the second default voltage and the driving transistor according to an emission control signal;

a compensation circuit coupled to the driving circuit and the control terminal of the driving transistor, and configured to receive a reference voltage and control an electrical connection between the control terminal of the driving transistor and the second terminal of the driving transistor according to a second control signal; and a discharge circuit coupled to the first terminal of the organic light emitting diode and an initial voltage, and configured to control the electrical connection between the first terminal of the organic light emitting diode and the initial voltage according to a third control signal, wherein:

during a first duration, the emission control signal is at a high voltage, the first control signal is at the high voltage, the second control signal is at a low voltage, and the third control signal is at the low voltage;

during a second duration after the first duration, the emission control signal is at the high voltage, the first control signal is at the low voltage, the second control signal is at the low voltage, and the third control signal is at the high voltage; and during a third duration after the second duration, the emission control signal is at the low voltage, the first control signal is at the high voltage, the second control signal is at the high voltage, and the third control signal is at the high voltage.

2. The pixel control circuit of claim 1, wherein the reference voltage is not greater than a sum of a difference between a maximum voltage of the data signal and an absolute value of a threshold voltage of the driving transistor and a difference between the second default voltage and a turn off voltage of the driving transistor, and the initial voltage is not greater than a difference between a minimum voltage of the data signal and the absolute value of the threshold voltage of the driving transistor and is smaller than a sum of the first default voltage and a threshold voltage of the organic light emitting diode.

3. The pixel control circuit of claim 1, wherein:

during a fourth duration before the first duration, the emission control signal is at the high voltage, the first control signal is at the high voltage, the second control signal is at the low voltage, and the third control signal is at the high voltage.

4. The pixel control circuit of claim 1, wherein:

during a fifth duration between the first duration and the second duration, the emission control signal is at the high voltage, the first control signal is at the high voltage, the second control signal is at the low voltage, and the third control signal is at the high voltage.

5. The pixel control circuit of claim 1, wherein:

during a sixth duration between the second duration and the third duration, the emission control signal is at the high voltage, the first control signal is at the high voltage, the second control signal is at the low voltage, and the third control signal is at the high voltage.

6. The pixel control circuit of claim 1, wherein the driving circuit comprises:

a second switch having a first terminal configured to receive the second default voltage, a second terminal coupled to the first terminal of the driving transistor, and a control terminal configured to receive the emission control signal; and a third switch having a first terminal configured to receive the second default voltage, a second terminal coupled to the compensation circuit, and a control terminal configured to receive the emission control signal.

7. The pixel control circuit of claim 6, wherein:

the compensation circuit comprises:

a capacitor having a first terminal coupled to the second terminal of the third switch, and a second terminal coupled to the control terminal of the driving transistor;

a fourth switch having a first terminal configured to receive the reference voltage, a second terminal coupled to the first terminal of the capacitor, and a control terminal configured to receive the second control signal; and a fifth switch having a first terminal coupled to the second terminal of the capacitor, a second terminal coupled to the second terminal of the driving transistor, and a control terminal configured to receive the second control signal; and the discharge circuit comprises:

a sixth switch having a first terminal configured to receive the initial voltage, a second terminal coupled to the second terminal of the driving transistor, and a control terminal configured to receive the third control signal.

8. The pixel control circuit of claim 6, wherein:

the compensation circuit comprises:

a capacitor having a first terminal coupled to the second terminal of the third switch, and a second terminal coupled to the control terminal of the driving transistor;

a fourth switch having a first terminal configured to receive the reference voltage, a second terminal coupled to the first terminal of the capacitor, and a control terminal configured to receive the second control signal;

a fifth switch having a first terminal coupled to the second terminal of the capacitor, a second terminal, and a control terminal configured to receive the second control signal; and a sixth switch having a first terminal coupled to the second terminal of the fifth switch, a second terminal coupled to the second terminal of the driving transistor, and a control terminal configured to receive the second control signal; and the discharge circuit comprises:

a seventh switch having a first terminal configured to receive the initial voltage, a second terminal coupled to the first terminal of the sixth switch, and a control terminal configured to receive the third control signal.

9. The pixel control circuit of claim 6, wherein:

the compensation circuit comprises:

a capacitor having a first terminal coupled to the second terminal of the third switch, and a second terminal coupled to the control terminal of the driving transistor;

a fourth switch having a first terminal configured to receive the initial voltage during the first duration and receive the reference voltage during the second duration and the third duration, a second terminal coupled to the first terminal of the capacitor, and a control terminal configured to receive the second control signal; and a fifth switch having a first terminal coupled to the second terminal of the capacitor, a second terminal coupled to the second terminal of the driving transistor, and a control terminal configured to receive the second control signal; and the discharge circuit comprises:

a sixth switch having a first terminal coupled to the second terminal of the fourth switch, a second terminal coupled to the first terminal of the fifth switch, and a control terminal configured to receive the third control signal.

10. The pixel control circuit of claim 1, wherein the driving circuit comprises:

a second switch having a first terminal configured to receive the second default voltage, a second terminal coupled to the first terminal of the driving transistor, and a control terminal configured to receive the emission control signal; and a third switch having a first terminal coupled to the second terminal of the second switch, a second terminal coupled to the compensation circuit, and a control terminal configured to receive the emission control signal.

11. The pixel control circuit of claim 10, wherein:

the compensation circuit comprises:

a capacitor having a first terminal coupled to the second terminal of the third switch, and a second terminal coupled to the control terminal of the driving transistor;

a fourth switch having a first terminal configured to receive the reference voltage, a second terminal coupled to the first terminal of the capacitor, and a control terminal configured to receive the second control signal; and a fifth switch having a first terminal coupled to the second terminal of the capacitor, a second terminal coupled to the second terminal of the driving transistor, and a control terminal configured to receive the second control signal; and the discharge circuit comprises:

a sixth switch having a first terminal configured to receive the initial voltage, a second terminal coupled to the second terminal of the driving transistor, and a control terminal configured to receive the third control signal.

12. The pixel control circuit of claim 10, wherein:

the compensation circuit comprises:

a capacitor having a first terminal coupled to the second terminal of the third switch, and a second terminal coupled to the control terminal of the driving transistor;

a fourth switch having a first terminal configured to receive the reference voltage, a second terminal coupled to the first terminal of the capacitor, and a control terminal configured to receive the second control signal;

a fifth switch having a first terminal coupled to the second terminal of the capacitor, a second terminal, and a control terminal configured to receive the second control signal; and a sixth switch having a first terminal coupled to the second terminal of the fifth switch, a second terminal coupled to the second terminal of the driving transistor, and a control terminal configured to receive the second control signal; and the discharge circuit comprises:

a seventh switch having a first terminal configured to receive the initial voltage, a second terminal coupled to the first terminal of the sixth switch, and a control terminal configured to receive the third control signal.

13. The pixel control circuit of claim 10, wherein:

the compensation circuit comprises:

a capacitor having a first terminal coupled to the second terminal of the third switch, and a second terminal coupled to the control terminal of the driving transistor;

a fourth switch having a first terminal configured to receive the initial voltage during the first duration and receive the reference voltage during the second duration and the third duration, a second terminal coupled to the first terminal of the capacitor, and a control terminal configured to receive the second control signal; and a fifth switch having a first terminal coupled to the second terminal of the capacitor, a second terminal coupled to the second terminal of the driving transistor, and a control terminal configured to receive the second control signal; and the discharge circuit comprises:

a sixth switch having a first terminal coupled to the second terminal of the fourth switch, a second terminal coupled to the first terminal of the fifth switch, and a control terminal configured to receive the third control signal.

14. The pixel control circuit of claim 1, wherein the driving circuit, the compensation circuit, the discharge circuit comprises P type transistors, the first switch and the driving transistor are P type transistors, the first default voltage is smaller than the second default voltage, and the second terminal of the organic light emitting diode is a cathode of the organic light emitting diode.

15. The pixel control circuit of claim 1, wherein the driving circuit, the compensation circuit, the discharge circuit comprises N type transistors, the first switch and the driving transistor are N type transistors, the first default voltage is greater than the second default voltage, and the second terminal of the organic light emitting diode is an anode of the organic light emitting diode.

* * * * *